US006647699B1

(12) United States Patent
Miller

(10) Patent No.: US 6,647,699 B1
(45) Date of Patent: Nov. 18, 2003

(54) SYSTEM AND METHOD FOR FRUIT PACKING

(75) Inventor: Barry J. Miller, Stockton, CA (US)

(73) Assignee: O-G Packing Co., Inc., Stockton, CA (US)

( * ) Notice: Subject to any disclaimer, the term of this patent is extended or adjusted under 35 U.S.C. 154(b) by 0 days.

(21) Appl. No.: 09/442,045

(22) Filed: Nov. 12, 1999

(51) Int. Cl.[7] ..... B65B 1/04
(52) U.S. Cl. ..... 53/467; 53/469; 53/384.1
(58) Field of Search ..... 53/473, 467, 469, 53/475, 249, 502, 247, 246, 256, 384.1, 449; 220/495.09

(56) References Cited

U.S. PATENT DOCUMENTS

| | | | | |
|---|---|---|---|---|
| 1,018,812 | A | | 2/1912 | Dujardin |
| 1,192,744 | A | | 7/1916 | Brough |
| 2,256,985 | A | | 9/1941 | Keogler |
| 2,689,077 | A | | 9/1954 | Main |
| 2,835,594 | A | | 5/1958 | Felt et al. |
| 2,893,550 | A | | 7/1959 | Sandmeyer |
| 3,224,569 | A | | 12/1965 | Leitzel |
| 3,298,511 | A | | 1/1967 | Schertz |
| 3,766,706 | A | | 10/1973 | Graham |
| 4,398,383 | A | * | 8/1983 | Prakken |
| 4,884,388 | A | | 12/1989 | Ventura et al. |
| 4,913,308 | A | | 4/1990 | Culbertson |
| 4,938,007 | A | * | 7/1990 | Sperry |
| 4,967,900 | A | | 11/1990 | Gossett |
| 4,979,353 | A | | 12/1990 | Seppala |
| 5,085,342 | A | | 2/1992 | Strawder |
| 5,095,686 | A | | 3/1992 | Marshall et al. |
| 5,150,563 | A | * | 9/1992 | Hartness |
| 5,190,252 | A | * | 3/1993 | Schrager |
| 5,212,932 | A | * | 5/1993 | Raudat |
| 5,238,139 | A | * | 8/1993 | Bisceglia |
| 5,320,241 | A | | 6/1994 | Evans |
| 5,333,751 | A | | 8/1994 | Santucci, Sr. |
| 5,354,569 | A | | 10/1994 | Brown et al. |
| 5,428,938 | A | * | 7/1995 | Davis |
| 5,605,031 | A | * | 2/1997 | Prakken |
| 5,813,196 | A | * | 9/1998 | Page et al. |
| 5,887,409 | A | * | 3/1999 | Leal Pereira Da Silva |
| 6,125,615 | A | * | 10/2000 | Germunson et al. |
| 6,131,371 | A | * | 10/2000 | Esser et al. |

* cited by examiner

*Primary Examiner*—Eugene Kim
(74) *Attorney, Agent, or Firm*—Townsend and Townsend and Crew LLP

(57) ABSTRACT

A filling device for filling secondary containers within a primary container. The filling device includes a filling platform that includes a base and filling channels that are in fluid communication with the base. The filling device also includes a retention platform for retaining secondary containers in contact with the filling platform during filling. The filling device, with secondary containers attached thereto, is placed within a primary container and material is supplied to the filling platform in order to fill the secondary containers. When complete, the filling device is removed and the filled secondary containers remain within the primary container.

10 Claims, 4 Drawing Sheets

SYSTEM AND METHOD FOR FRUIT PACKING

BACKGROUND OF THE INVENTION

1. Field of the Invention

The present invention relates to a system and method for filling at least two secondary containers within a primary container, and more particularly, to a system and method for filling at least two bags with fruit within a box.

2. Description of the Prior Art

Packages of items or material are often sold in individual packages. These packages are generally shipped to a sales point, such as a store, in larger containers, such as boxes. Hence, the bags must be filled and the bags placed in the shipping container.

An example of items sold at stores in bags and shipped to the stores in boxes is fruit. The individual bags must be filled with the fruit and the bags need to be shipped to the store. Thus, the fruit must be placed in the bags and the bags then placed in the shipping containers, which are generally boxes.

Generally, a total weight for the boxes is desired. Thus, the individual bags containing the fruit may have slightly varying weights, with the total weight of all bags substantially equaling the total desired weight for the shipping box. Often the individual bags are not sealed until they arrive at the store. Once at the store, the box is opened, the individual bags are weighed and marked and the bags may be sealed.

SUMMARY OF THE INVENTION

In accordance with the present invention, a device for filling at least two secondary containers within a primary container includes a filling platform that includes a base and at least two filling channels with the two filling channels being in fluid communication with the base. The device also includes a retention platform for retaining the at least two secondary containers in contact with the filling platform during filling.

In accordance with one aspect of the present invention, the at least two filling channels are cylinders.

In accordance with another aspect of the present invention, the number of filling channels is in a range between two and thirty.

In accordance with yet another aspect of the present invention, the retention platform fits the filling platform.

In accordance with a further aspect of the present invention, the retention platform fits around the filling platform.

In accordance with the present invention, a method of filling at least two secondary containers within a primary container includes engaging the secondary containers with filling channels of a filling platform, engaging a retention platform with the filling platform in order to retain the secondary containers in engagement with the filling platform, placing the filling platform and retention platform in the primary container and supplying the material to the filling platform such that the material moves into secondary containers through the filling channels.

In accordance with another aspect of the present invention, the method includes moving material along a conveyor belt to a supply station for supplying the material to the filling platform and moving the primary container to the supply station.

Other features and advantages of the present invention will be understood upon reading and understanding the detailed description of the preferred exemplary embodiments, found hereinbelow in conjunction with reference to the drawings in which like numerals represent like elements.

DETAILED DESCRIPTION OF THE PREFERRED EXEMPLARY EMBODIMENTS

Figure 1:
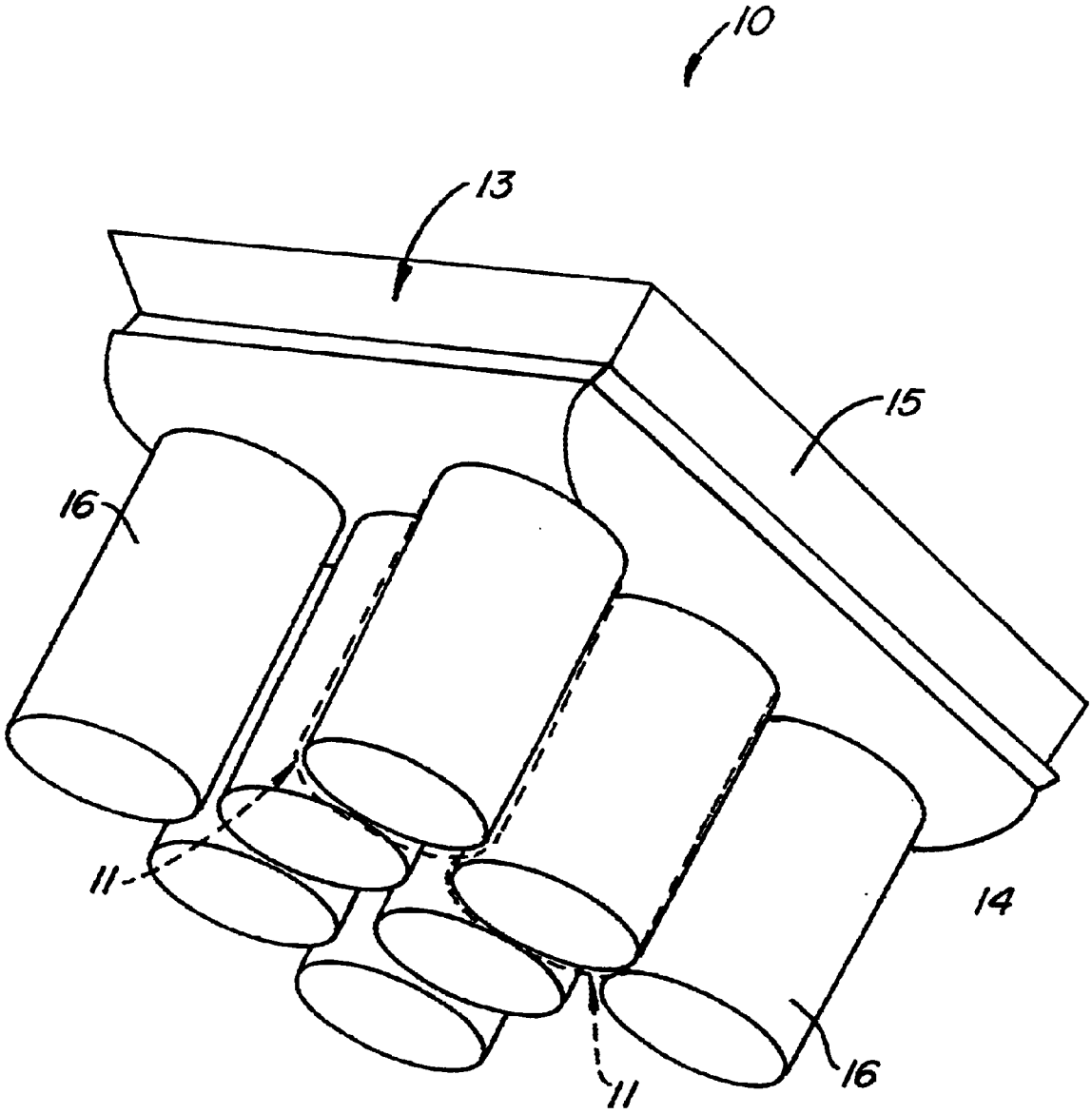
FIG. 1 is a perspective view of a filling device in accordance with the present invention.
Figure 3:
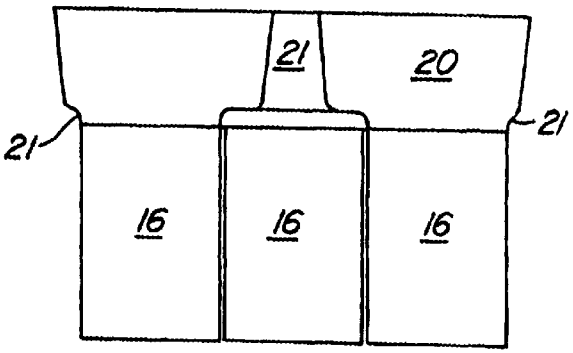
FIG. 3 is an end elevation view of the filling platform of the filling device in accordance with the present invention.

In accordance with the present invention, a device 10 for filling secondary containers 11 within a primary container 12 includes a filling platform 13 and a retention platform 14. The filling platform includes a base 15 and filling channels 16 in fluid communication with the base. The retention platform includes a plurality of holes or bores 17 defined therein. The shape of the retention platform is generally the same as the shape of the filling platform without the filling channels. The number of holes corresponds to the number of filling channels on the filling platform.

In a preferred embodiment, the filling channels are cylindrical in shape and thus, are essentially tubes.

In a preferred embodiment, the base of the filling platform is slightly sloped towards the openings of the filling channels. Additionally, walls 20 defining the filling platform are also preferably sloped at corners 21.

In a preferred embodiment, the filling platform includes two alignment portions 22 for aligning the filling platform with the retention platform. Of course, those skilled in the art will understand that there may be only one alignment portion or more than two alignment portions. Additionally, if it is so desired, no alignment portions need be included.

Retention platform 14, in such a preferred embodiment, includes two corresponding alignment portions 23 for aligning with alignment portions 22 of filling platform 13. These alignment portions make it easier for ensuring that the retention platform and the filling platform, when engaged, are properly aligned with respect to the holes of the retention platform and the filling channels of the filling platform.

Those skilled in the art will understand that the filling platform may include as many filling channels, and correspondingly the holes defined within the retention platform, as desired. Preferably, there are between two and thirty filling channels. In an exemplary embodiment illustrated in the drawings, there are eight filling channels. In such an exemplary embodiment, the width of the filling device is approximately 14 inches, the length is approximately 15 inches, and the height is approximately 10¼ inches. A radius defined by corners 21 is approximately 2 inches while the diameter of the filling channels is approximately 4/10 inches. The diameter of bores 17 within the retention platform, because they need to fit over channel 16, is approximately ½ inch.

In use, before filling device 10 is placed in a primary container 12, a secondary container 11, in this example, a bag, is placed on each of the filling channels 16. Retention platform 14 is then placed over the bags so that a base of the retention platform engages base 15 of filling platform 13 in order to hold the bags at least against the filling platform base and preferably, against the filling channels. The filling device is then placed into the primary container.

Figure 6:
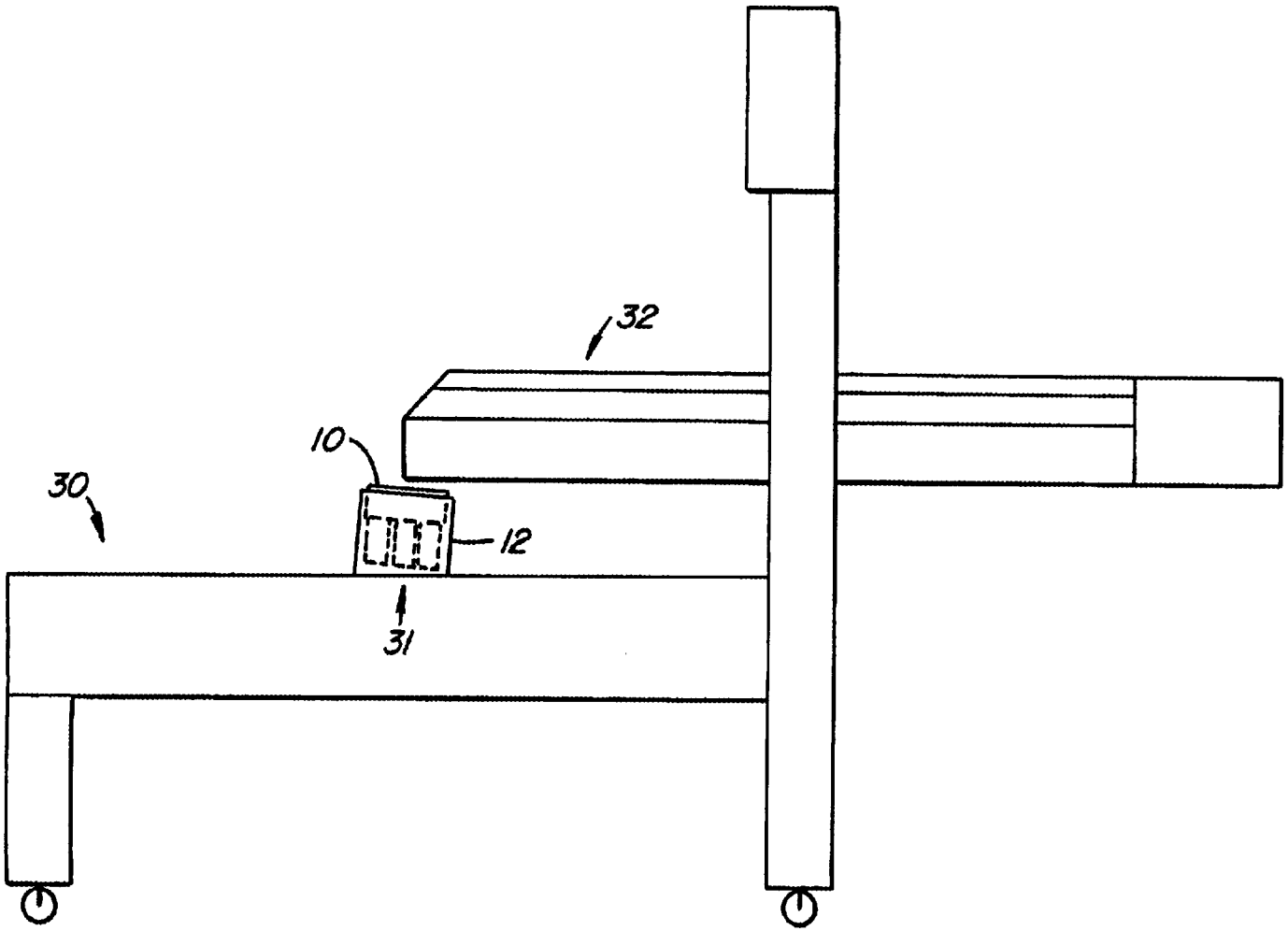
FIG. 6 is a schematic illustration of a filling system using the filling device in accordance with the present invention.

The primary container may then be moved to a supply station so that the bags can be filled with material. In a preferred embodiment, the present invention is used to fill the bags with fruit. As can be seen in FIG. 6, boxes including filling devices are moved along a conveyor 30 to a supply station 31 such that the boxes are under a second conveyor 32. Fruit is then moved along the second conveyor dropping off the end of the conveyor at the supply station and into the filling platform. The fruit then falls into the filling channels and thus into the bags.

Preferably, the total weight within the shipping container is the desired weight and thus, each bag does not require the same weight of fruit therein. Thus, once the shipping container has received the proper weight of fruit, the filling platform is removed from the retention platform and then the retention platform is removed from the shipping container leaving the filled bags in the shipping container. Bags may then be sealed as desired. However, often the bags are left unsealed and upon arrival of the shipping container at the ultimate selling point, such as a grocery store or fruit stand, the bags are removed from the shipping container, and are weighed and may be sealed, with the weight marked thereon.

Figure 4:
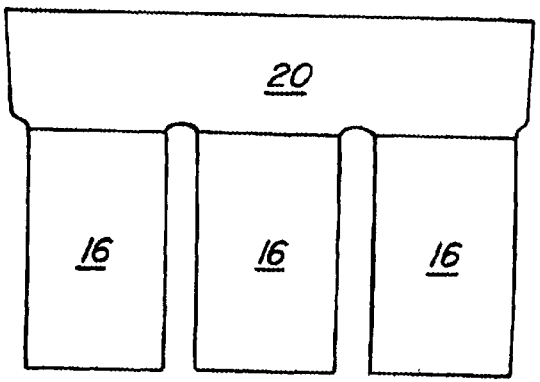
FIG. 4 is a side elevation view of the filling platform of the filling device in accordance with the present invention.
Figure 2:
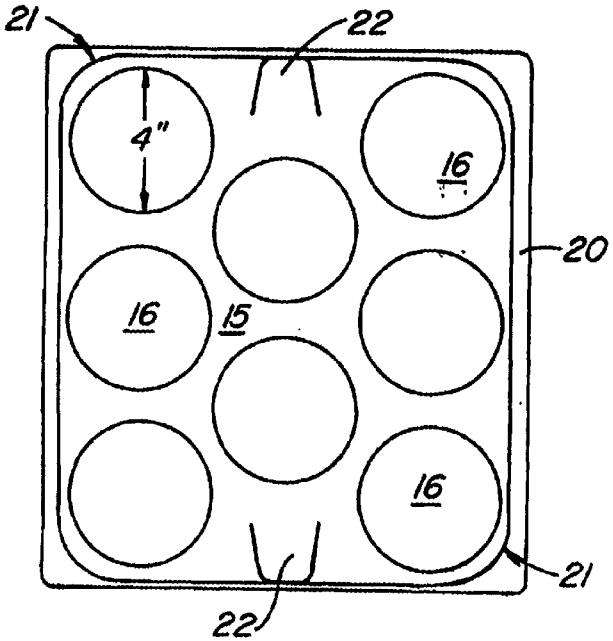
FIG. 2 is a top plan view of a filling platform of the filling device in accordance with the present invention.
Figure 5:
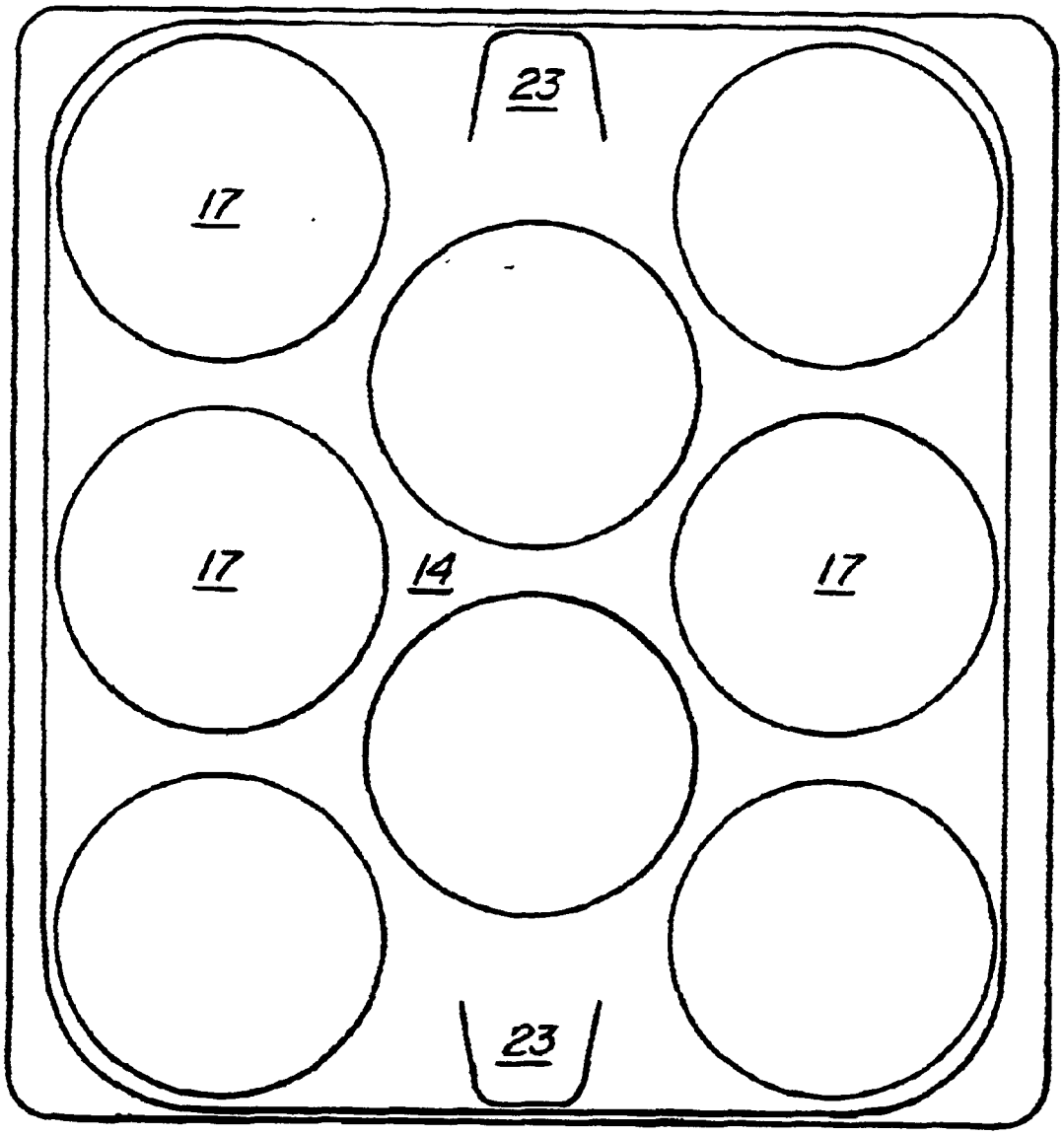
FIG. 5 is a top plan view of a retention platform of the filling device in accordance with the present invention.

The present invention is useful for filling secondary containers within a primary container, especially for filling fruit in bags that are shipped within a shipping container or box. The filling device is generally, but not necessarily, used in conjunction with an automatic box filler that is commonly used in the packing industry to fill boxes of various sizes and weight. FIG. 4 illustrates an example of such an automatic box filler.

The filling device is capable of rapidly filling bags held by the device such that the preset weight desired by the packer for the shipping container may be realized quickly. Since it is often not necessary that each bag have a prescribed weight in it and that the master container merely needs to have a prescribed weight, the filling device facilitates rapid filling of secondary containers within a primary container.

Although the invention has been described with reference to specific exemplary embodiments, it will appreciated that it is intended to cover all modifications and equivalents within the scope of the appended claims.

What is claimed is:

1. An arrangement for filling a plurality of secondary containers, the arrangement comprising:

a base platform comprising four walls and a floor;

a plurality of openings defined within the base platform floor;

a filling channel extending from each opening;

a retention platform comprising four walls and a floor; and a plurality of openings defined within the retention platform floor;

wherein the openings of the retention platform are located such that the retention platform mates with the base platform to secure secondary containers adjacent the filling channels.

2. An arrangement in accordance with claim 1 wherein each filling channel extends into a corresponding secondary container.

3. An arrangement in accordance with claim 1 wherein each filling channel is cylindrical.

4. An arrangement in accordance with claim 1 wherein the base platform floor is sloped towards the openings.

5. An arrangement in accordance with claim 1 wherein corners defined by the four walls of the base platform are sloped towards the openings.

6. An arrangement in accordance with claim 1 further comprising at least one alignment portion defined within at least one wall of the base platform and at least one wall of the retention platform.

7. An arrangement for filling a plurality of secondary containers, the arrangement comprising:

a base platform comprising four walls and a floor;

a plurality of openings defined within the base platform floor;

a filling channel extending from each opening;

a retention platform comprising four walls and a floor; and a plurality of openings defined within the retention platform floor;

wherein the openings of the retention platform are located such that the retention platform mates with the base platform to secure secondary containers adjacent the filling channels;

wherein each filling channel extends into a corresponding secondary container;

wherein the base platform floor is sloped towards the openings; and wherein corners defined by the four walls of the base platform are sloped towards the openings.

8. An arrangement in accordance with claim 7 wherein each filling channel is cylindrical.

9. An arrangement in accordance with claim 7 further comprising at least one alignment portion defined within at least one wall of the base platform and at least one wall of the retention platform.

10. A method of filling secondary containers within a primary container, the method comprising:

providing an arrangement comprising:

a base platform comprising four walls and a floor;

a plurality of openings defined within the base platform floor;

a filling channel extending from each opening;

a retention platform comprising four walls and a floor; and a plurality of openings defined within the retention platform floor;

wherein the openings of the retention platform are located such that the retention platform mates with the base platform to secure secondary containers adjacent the filling channels;

placing a secondary container adjacent each filling channel;

mating the retention platform with the base platform;

placing the arrangement adjacent the primary container; and filling the secondary containers with product through the arrangement.

* * * * *